US007299651B2

(12) United States Patent
Oh

(10) Patent No.: US 7,299,651 B2
(45) Date of Patent: Nov. 27, 2007

(54) ASSEMBLY STRUCTURE OF A COOLING AIR SUPPLYING DUCT FOR USE IN A REFRIGERATOR HAVING CANTILEVER SHELVES

(75) Inventor: Jeong Baek Oh, Seoul (KR)

(73) Assignee: Daewoo Electronics Corporation, Seoul (KR)

( * ) Notice: Subject to any disclaimer, the term of this patent is extended or adjusted under 35 U.S.C. 154(b) by 426 days.

(21) Appl. No.: 11/002,210

(22) Filed: Dec. 3, 2004

(65) Prior Publication Data

US 2005/0126206 A1 Jun. 16, 2005

(30) Foreign Application Priority Data

Dec. 12, 2003 (KR) ..... 10-2003-0090576

(51) Int. Cl.
*F25D 17/04* (2006.01)

(52) U.S. Cl. ..... 62/407; 62/441

(58) Field of Classification Search ..... 62/407, 62/441; 312/404, 408; 108/108; 248/222.11, 248/222.12

See application file for complete search history.

(56) References Cited

U.S. PATENT DOCUMENTS

| | | | | |
|---|---|---|---|---|
| 4,244,637 | A * | 1/1981 | Boorman, Jr. | 312/350 |
| 5,454,638 | A * | 10/1995 | Bird et al. | 312/408 |
| 5,664,437 | A * | 9/1997 | Park et al. | 62/407 |
| 6,347,530 | B1 * | 2/2002 | Kim | 62/407 |
| 2002/0059805 | A1 * | 5/2002 | Lee et al. | 62/407 |

* cited by examiner

*Primary Examiner*—Melvin Jones
(74) *Attorney, Agent, or Firm*—Bacon & Thomas, PLLC

(57) ABSTRACT

An assembly structure of a cooling air supplying duct for use in a refrigerator having cantilever shelves includes a shelf supporting rail having a front wall in which a plurality of engagement slots are formed, and a cooling air discharging duct. The cooling air discharging duct is provided with an engaging opening formed in a portion thereof and a front wall in which a plurality of cooling air discharging holes for discharging cooling air to an interior of the refrigerator are formed. The shelf supporting rail is vertically fixed on an inner wall of the refrigerator and is combined with the cooling air discharging duct by being inserted into the engaging opening.

3 Claims, 7 Drawing Sheets

ASSEMBLY STRUCTURE OF A COOLING AIR SUPPLYING DUCT FOR USE IN A REFRIGERATOR HAVING CANTILEVER SHELVES

FIELD OF THE INVENTION

The present invention relates to an assembly structure of a cooling air supplying duct for use in a refrigerator; and, more particularly, to an assembly structure of a cooling air supplying duct for use in a refrigerator having cantilever shelves, which is capable of being easily installed on an inner wall of a refrigerator.

BACKGROUND OF THE INVENTION

As illustrated in FIGS. 1A and 1B, an interior of the refrigerator is divided into a freezing compartment 10 and a refrigerating compartment 30 by means of a barrier 20 that is filled with an insulating material. An evaporator 12, through which a coolant of low temperature and low pressure passes, is mounted in an interior of a heat exchange chamber 11 that is disposed in a rear portion of the freezing compartment 10. A fan 14 is provided over the evaporator 12 so as to forcibly send cooling air, which is generated by the evaporator 12, to the freezing compartment 10 and the refrigerating compartment 30.

Formed in the barrier 20 are a cooling air supplying passage 22, through which the cooling air generated by the evaporator 12 in the heat exchange chamber 11 is supplied to the refrigerating compartment 30, and an air returning passage 24, through which air warmed while being circulated in the refrigerating compartment 30 is returned toward the evaporator 12.

Further, the lower end of the cooling air supplying passage 22 formed in the barrier 20 is connected to a cooling air discharging unit 32. The cooling air discharging unit 32 is widely formed in a ceiling of the refrigerating compartment 30 and serves to discharge the cooling air supplied therein to an interior of the refrigerating compartment 30.

As shown in FIG. 1B, a plurality of shelf supporting rails 38*a*, each having a plurality of engagement slots 38*a*', are vertically mounted on an inner wall 38 of the refrigerating compartment 30. More particularly, two are mounted on a right and left portion of the inner wall 38 of the refrigerating compartment 30 and one is mounted on a central portion of the inner wall 38. The shelf supporting rails 38*a* serve to support cantilever shelves 34 with hooks of support brackets (not shown) of the cantilever shelves 34 respectively inserted into and engaged with the engagement slots 38*a*' thereof.

Additionally, a vegetable compartment 36 is provided in a lower portion of the refrigerating compartment 30, and a machine room M, in which a compressor 40 is mounted, is formed in a lower, rear portion of the refrigerator.

Hereinafter, the circulation of the cooling air in the refrigerator with the configuration as described above will be described.

One portion of the cooling air is supplied to the freezing compartment 10 by means of the fan 14, and the remaining portion of the cooling air is supplied toward the refrigerating compartment 30 by means of the fan 14. The cooling air, which is supplied toward the refrigerating compartment 30, descends down from the heat exchange chamber 11 to the cooling air discharging unit 32 formed in the ceiling of the refrigerating compartment 30 through the cooling air supplying passage 22 formed in the barrier 20. Then, the cooling air is discharged from the cooling air discharging unit 32 to be introduced into the interior of the refrigerating compartment 30, and, subsequently, is supplied to divisions partitioned by the cantilever shelves 34 and the vegetable compartment 36 over a period of time.

The refrigerator with the configuration as described above has problems as follows. The cooling air is supplied to the refrigerating compartment 30 via the cooling air discharging unit 32 formed in the ceiling of the refrigerating compartment 30. So, gradually the cooling air flows from the upper cantilever shelf 34 to the lower cantilever shelf 34 over a period of time. Therefore, the cooling air, which reaches the lowermost cantilever shelves 34, has a relatively high temperature, which hinders the interior of the refrigerating compartment 30 from being cooled uniformly. This also deteriorates a cooling speed of the refrigerating compartment 30.

To address the aforementioned problems, U.S. Pat. No. 6,347,530 entitled "COOLING AIR SUPPLYING STRUCTURE FOR A REFRIGERATOR HAVING CANTILEVER SHELVES" discloses a cooling air supplying structure, which includes a cooling air supplying duct being vertically mounted on the inner wall of the refrigerating compartment, shelf support rails having a plurality of engagement slots, at least one of the shelf supporting rails being mounted to the cooling air supplying duct, and cantilever shelves respectively supported by the shelf supporting rails.

However, the cooling air supplying structure disclosed in the aforementioned U.S. patent has a problem that it is difficult to install the cooling air supplying structure on the inner wall of the refrigerating compartment since the cooling air supplying duct has a recessed portion on its central portion for receiving one of the shelf supporting rails, and the one of the shelf supporting rails and the cooling air supplying duct have to be screw-fixed together to the inner wall of the refrigerating compartment.

SUMMARY OF THE INVENTION

It is, therefore, an object of the present invention to provide an assembly structure of a cooling air supplying duct for use in a refrigerator having cantilever shelves, which is capable of being easily installed on an inner wall of a refrigerator.

In accordance with the present invention, there is provided an assembly structure of a cooling air supplying duct for use in a refrigerator having cantilever shelves, the assembly structure including: a shelf supporting rail having a front wall in which a plurality of engagement slots are formed, the shelf supporting rail being vertically fixed on an inner wall of the refrigerator; and a cooling air discharging duct having: an engaging opening formed in a portion thereof; and a front wall in which a plurality of cooling air discharging holes for discharging cooling air to an interior of the refrigerator are formed, wherein the shelf supporting rail is combined with the cooling air discharging duct by being inserted into the engaging opening, and supports the cantilever shelves.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1A:
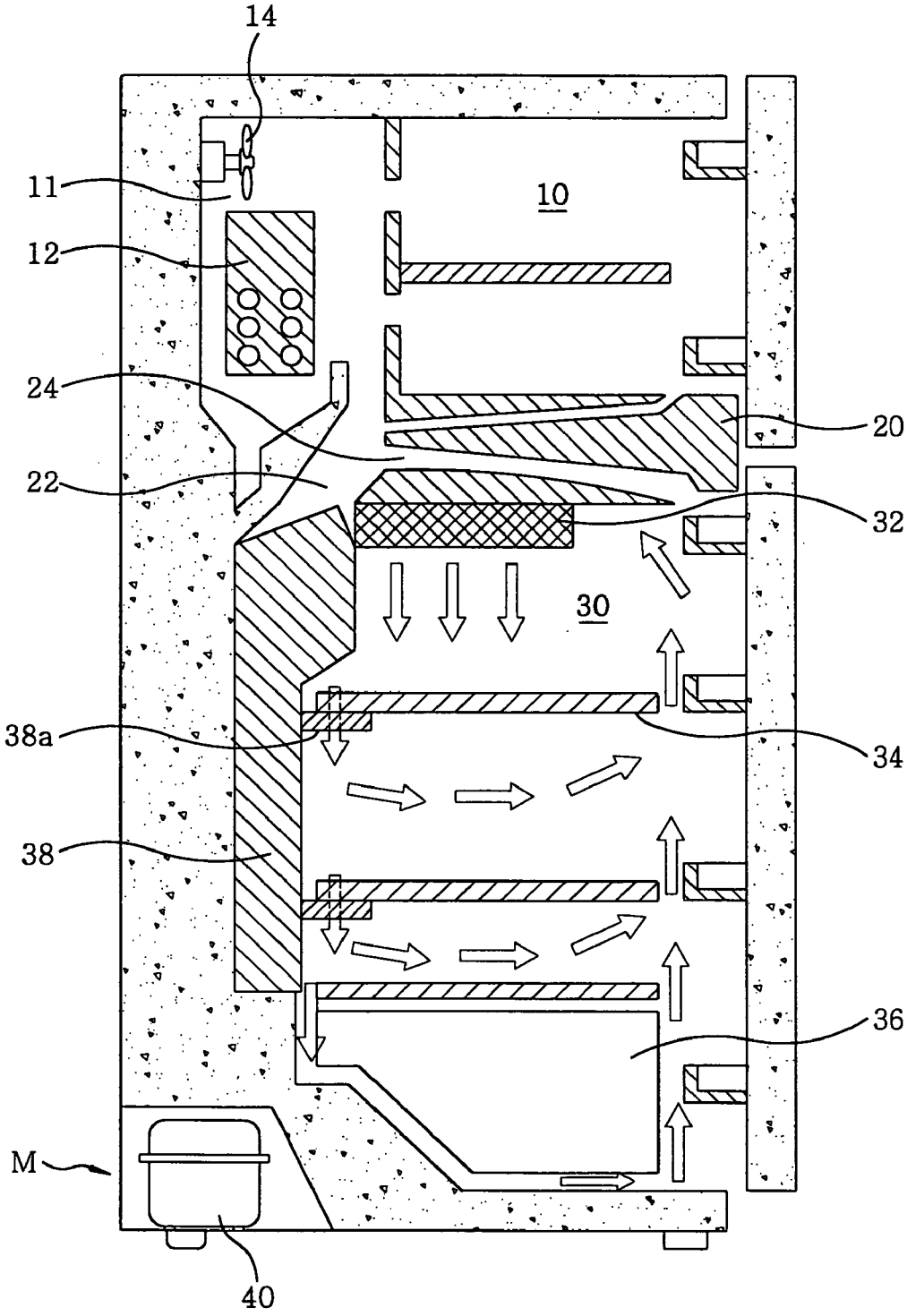
FIG. 1A (PRIOR ART)
FIG. 1A is a cross sectional view of a conventional refrigerator having cantilever shelves.
Figure 1B:
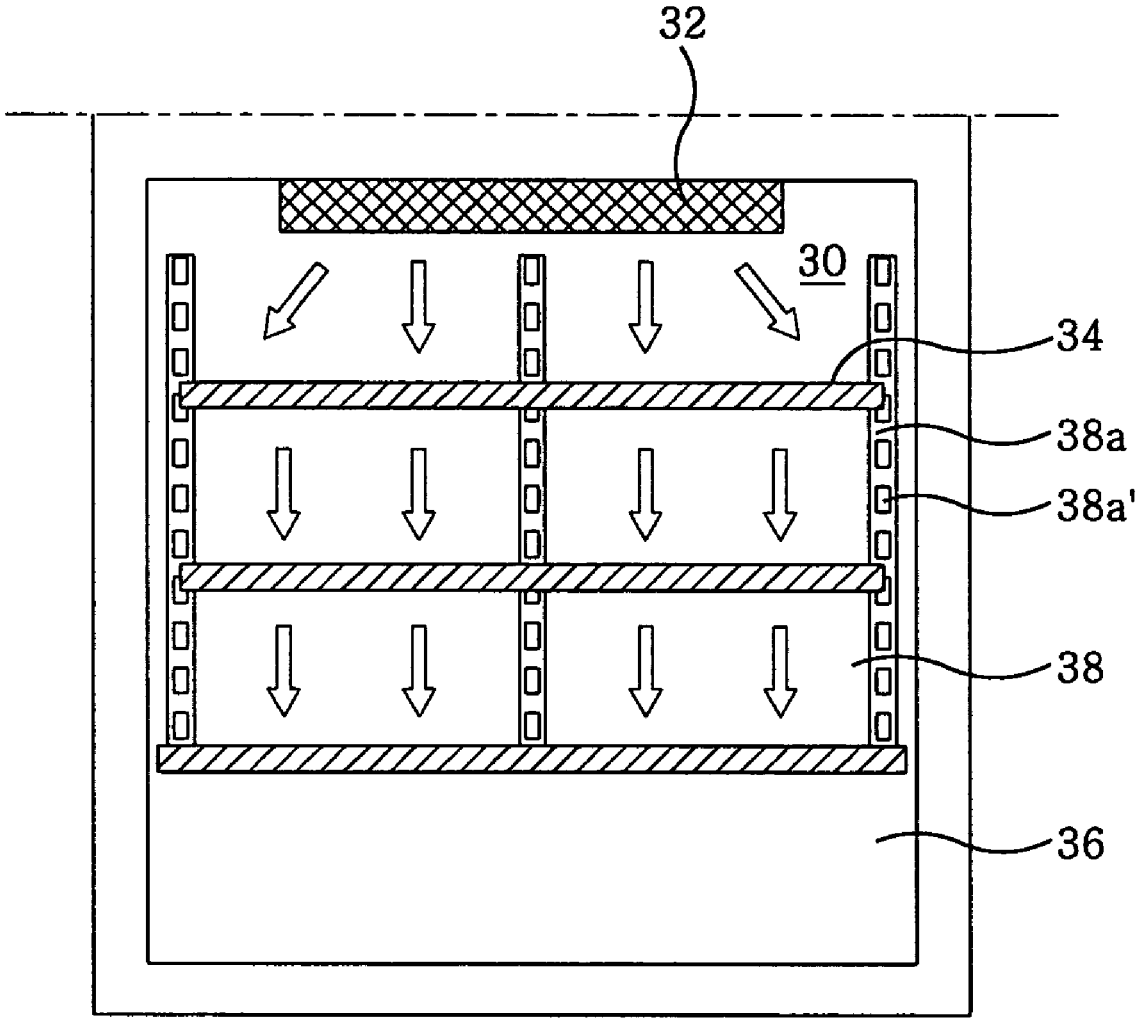
FIG. 1B (PRIOR ART)
FIG. 1B presents a front view of a refrigerating compartment of the conventional refrigerator of FIG. 1A.

Hereinafter, an assembly structure of a cooling air supplying duct for use in a refrigerator having cantilever shelves in accordance with a preferred embodiment of the present invention will be described in detail with reference to the accompanying drawings, wherein like parts to those of the prior art are represented by like reference characters and detailed descriptions thereof will be omitted for simplicity.

Figure 2:
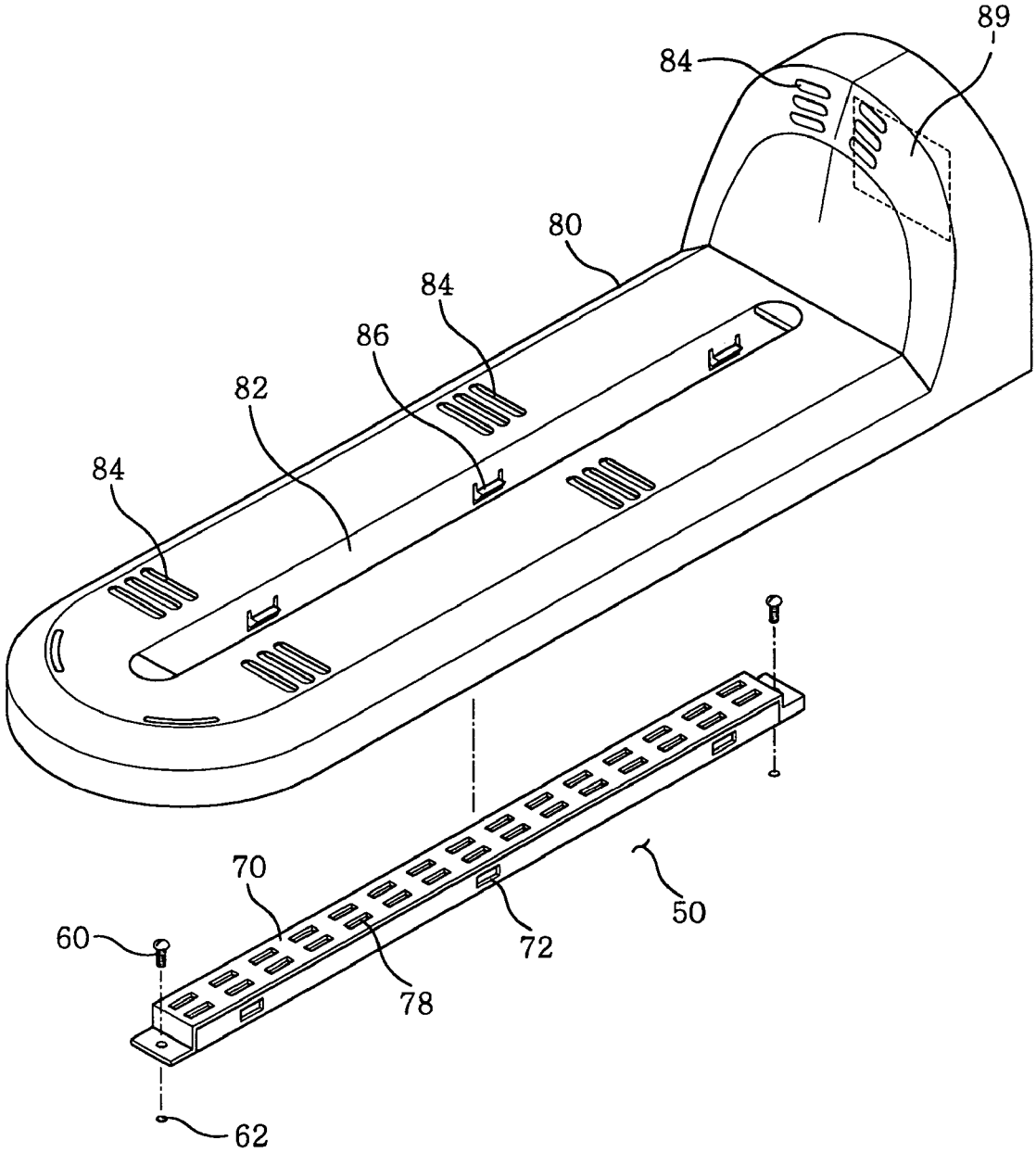
FIG. 2 shows an exploded perspective view of an assembly structure of a cooling air supplying duct for use in a refrigerator having cantilever shelves in accordance with a preferred embodiment of the present invention.
Figure 3:
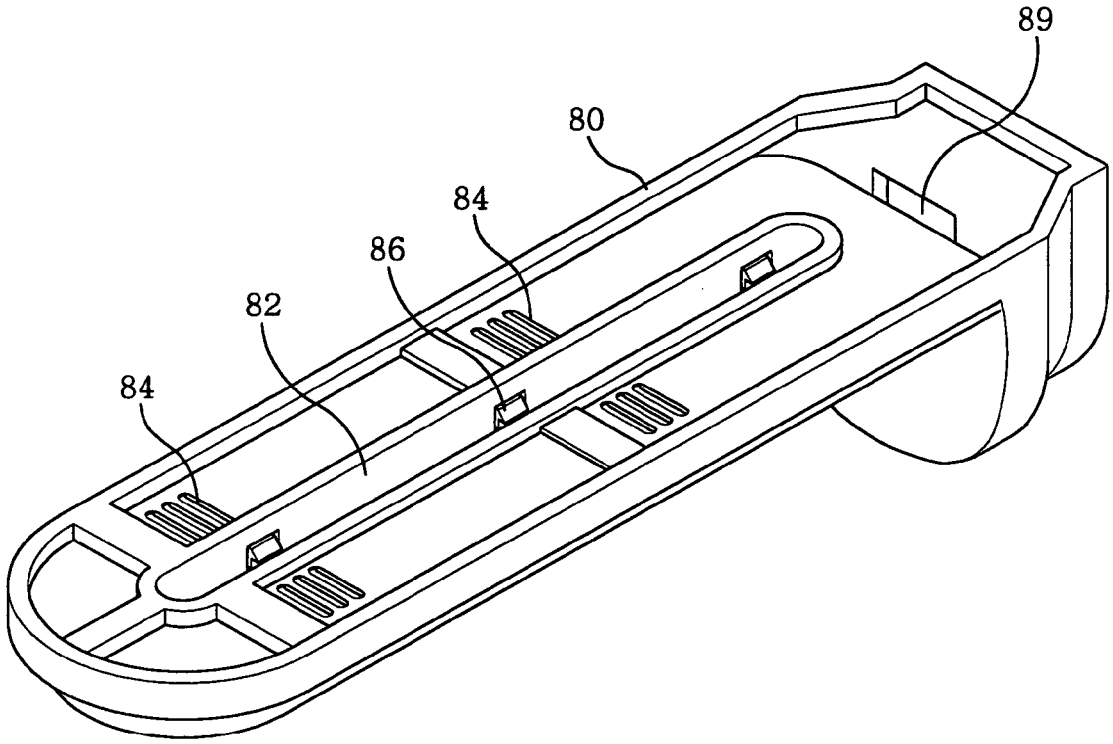
FIG. 3 illustrates rear perspective view of a cooling air discharging duct.

Referring to FIG. 2, there is illustrated an exploded perspective view of an assembly structure of a cooling air supplying duct for use in a refrigerator having cantilever shelves in accordance with a preferred embodiment of the present invention, and FIG. 3 illustrates a rear perspective view of a cooling air discharging duct.

As illustrated in FIGS. 2 and 3, in the assembly structure of a cooling air supplying duct for use in a refrigerator having cantilever shelves in accordance with the preferred embodiment of the present invention, a shelf supporting rail 70 is vertically fixed on a central portion of an inner wall 50 of a refrigerating compartment 30 (see FIG. 4) with screws 60 being tightened into fixation holes 62 formed in the inner wall 50. An upper portion of the cooling air discharging duct 80 is projected frontward, and a lower portion thereof is flatly formed with a specific height. Vertically formed in a central portion of the lower portion of the cooling air discharging duct 80 is an engaging opening 82 into which the shelf supporting rail 70 is inserted from a back of the cooling air discharging duct 80. On both sidewalls of the engaging opening 82, a plurality of elastic plugs 86 are provided while in both sidewalls of the shelf supporting rail 70, a plurality of connection holes 72 corresponding to the elastic plugs 86 are formed. When the shelf supporting rail 70 is inserted into the engaging opening 82, the elastic plugs 86 are engaged into the corresponding connection holes 72. Therefore, the cooling air discharging duct 80 is fixedly combined with the shelf supporting rail 70. Further, a plurality of cooling air discharging holes 84 are formed at predetermined positions of the upper and lower portion of the cooling air discharging duct 80.

Further, in the upper portion of the cooling air discharging duct 80, a cooling air inlet port 89 for receiving the cooling air from a heat exchange chamber is formed. The cooling air, introduced into the cooling air discharging duct 80 through the cooling air inlet port 89, flows downward through a channel 87 formed between the cooling air discharging duct 80 and the inner wall 50 of the refrigerating compartment 30 (or a base plate (not shown) of the cooling air discharging duct 80), so that the cooling air is supplied to an upper and lower portion of the refrigerating compartment 30 simultaneously through the cooling air discharging holes 84.

The shelf supporting rail 70 shown in FIG. 2 is for half-width cantilever shelves 90 (see FIG. 4), and two columns of engagement slots 78 are formed in a front wall of the shelf supporting rail 70.

Figure 4:
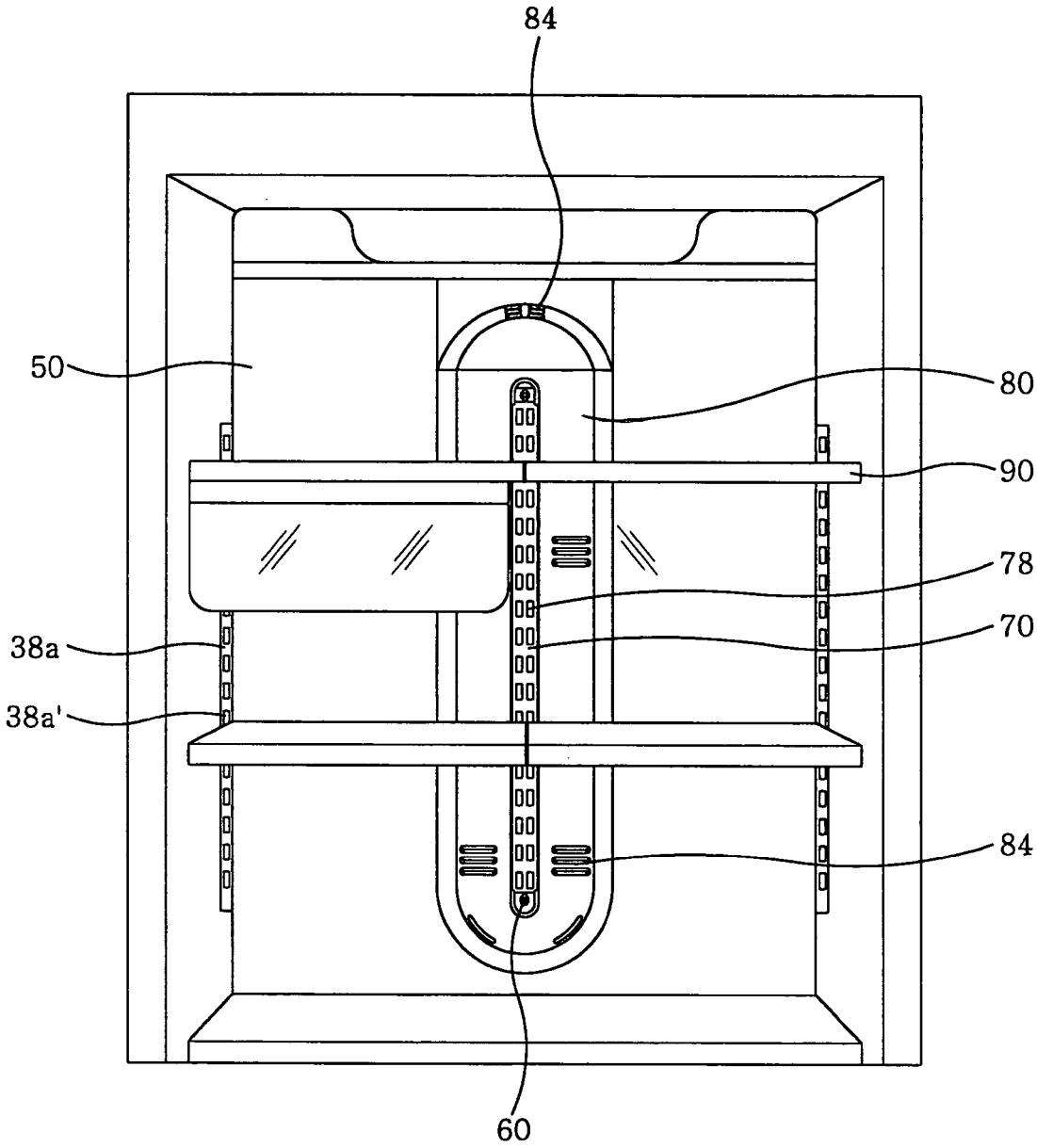
FIG. 4 illustrates a front perspective view of the assembly structure of a cooling air supplying duct, which has the shelf supporting rail with two columns of engagement slots, and which is installed on an inner wall of the refrigerating compartment.

Referring to FIG. 4, there is illustrated a front perspective view of the assembly structure of a cooling air supplying duct, which has the shelf supporting rail 70 with the two columns of the engagement slots 78, and which is installed on the inner wall 50 of the refrigerating compartment 30. The half-width cantilever shelves 90 are supported by shelf supporting rails 38*a* installed on a right and left portion of the inner wall 50 as well as the shelf supporting rail 70 fixed on the central portion of the inner wall 50 with hooks (not shown) of the half-width cantilever shelves 90 inserted into the engagement slots 38*a*' and 78 thereof.

Figure 5:
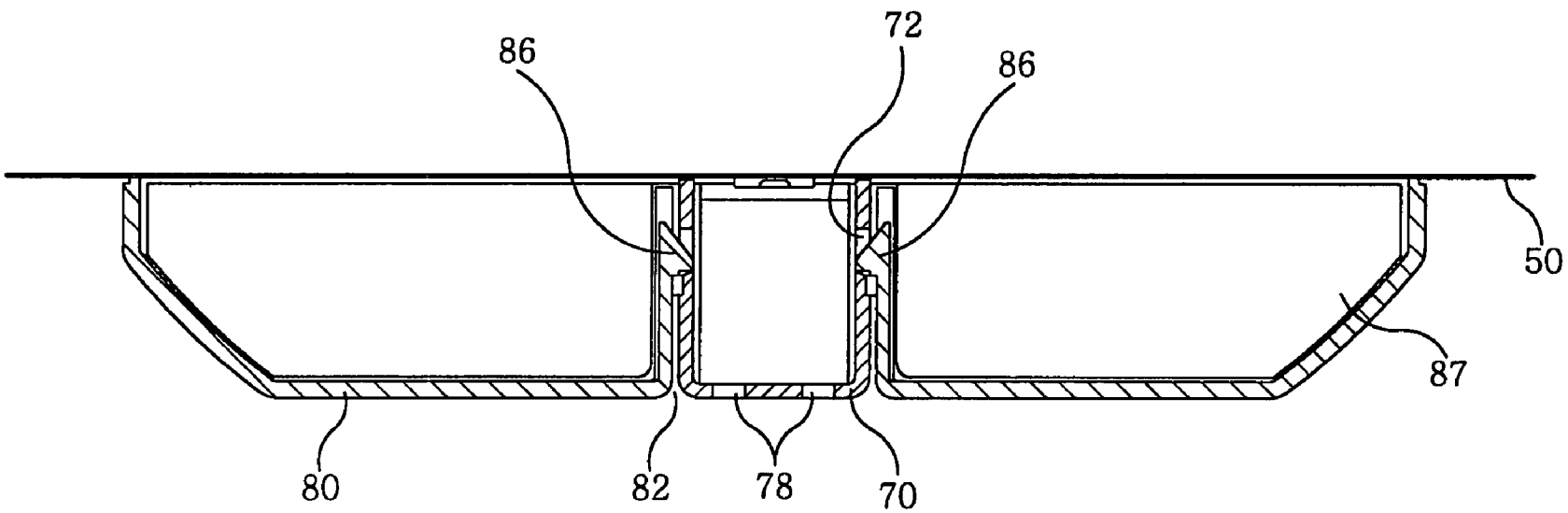
FIG. 5 presents a cross sectional view of the assembly structure of a cooling air supplying duct, which ha's the shelf supporting rail for half-width cantilever shelves, and which is installed on the inner wall of the refrigerating compartment.

FIG. 5 presents a cross sectional view of the assembly structure of a cooling air supplying duct, which has the shelf supporting rail 70 for the half-width cantilever shelves 90, and which is installed on the inner wall 50 of the refrigerating compartment 30. As shown in this drawing, the height of the front wall of the cooling air discharging duct 80 (or depth of the engaging opening 82) is approximately equal to that of the front wall of the shelf supporting rail 70. First, the shelf supporting rail 70 is vertically fixed on the central portion of the inner wall 50 with the screws 60 being tightened into the fixation holes 62, and then the cooling air discharging duct 80 is combined with the shelf supporting rail 70 by inserting the shelf supporting rail 70 into the engaging opening 82 while the elastic plugs 86 of the combining opening 82 are engaged into the connection holes 72 of the shelf supporting rail 70. Next, the half-width cantilever shelves 90 are installed in the refrigerating compartment 30 by inserting the hooks thereof into the engagement slots 38*a*' and 78 of the shelf supporting rails 38*a* and 70.

Figure 6:
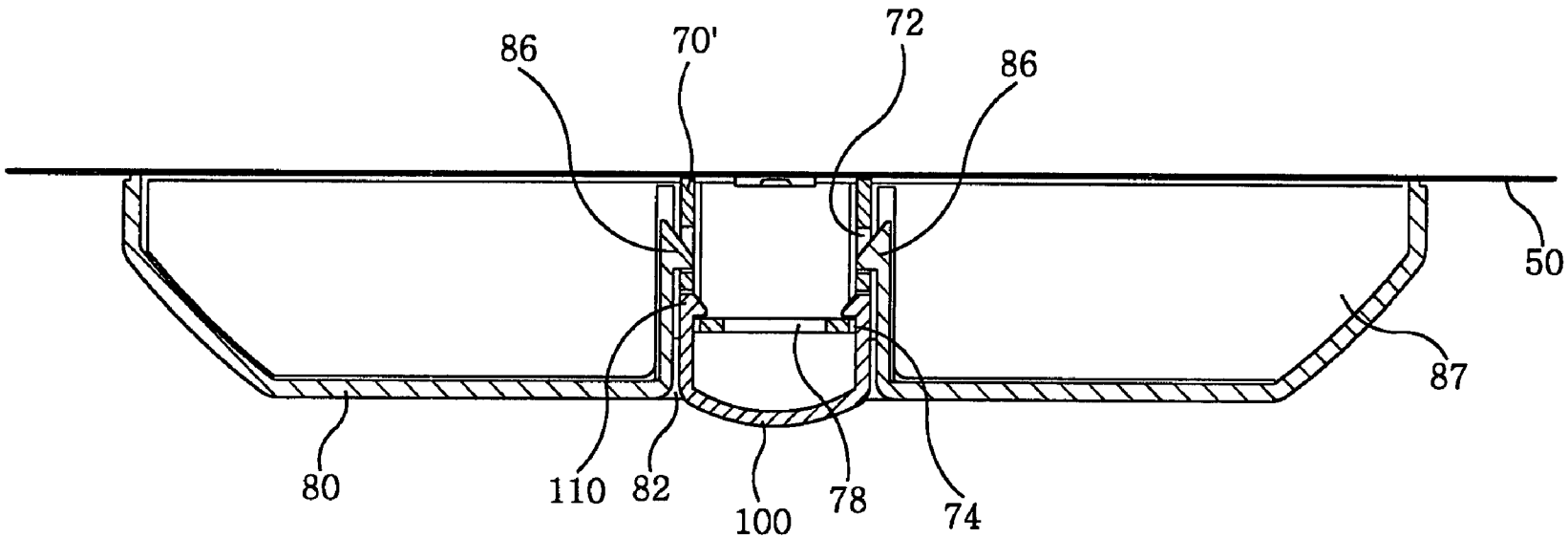
FIG. 6 provides a cross sectional view of the assembly structure of a cooling air supplying duct, which has a shelf supporting rail for full-width cantilever shelves, and which is installed on the inner wall of the refrigerating compartment.

Referring to FIG. 6, there is provided a cross sectional view of a assembly structure of the cooling air supplying duct, which has a shelf supporting rail 70' for full-width cantilever shelves (not shown), and which is installed on the inner wall 50 of the refrigerating compartment 30. The shelf supporting rail 70' for full-width cantilever shelves has a plurality of engagement slots 78 arranged in one column. As shown in this drawing, the height of the front wall of the cooling air discharging duct 80 is higher than that of the front wall of the shelf supporting rail 70'. A decorative cover part 100 having a height substantially equal to a height difference between the front wall of the cooling air discharging duct 80 and the front wall of the shelf supporting rail 70' is inserted into the engaging opening 82. Also, elastic plugs 110, provided at both sidewalls of the decorative cover part 100, are engaged into connection holes 74 formed at both sidewalls of the shelf supporting rail 70' above the connection holes 72. First, the shelf supporting rail 70' is vertically fixed on the central portion of the inner wall 50 with the screws 60 being tightened into the fixation holes 62, and then the cooling air discharging duct 80 is combined with the shelf supporting rail 70' by inserting the shelf supporting rail 70' into the engaging opening 82 while the elastic plugs 86 of the engaging opening 82 are engaged into the connection holes 72 of the shelf supporting rail 70'. Next, the decorative cover part 100 is inserted into the engaging opening 82 of the cooling air discharging duct 80. Then, the full-width cantilever shelves are installed in the refrigerating compartment 30 by inserting the hooks thereof into the engagement slots 38*a*' and 78 of the shelf supporting rails 38*a* and 70'.

As described above, the assembly structure of the cooling air supplying duct for use in a refrigerator having cantilever shelves in accordance with the preferred embodiment of the present invention is easily installed on an inner wall of a refrigerator. Moreover, it is possible to selectively use the full-width or the half-width cantilever shelves.

While the invention has been shown and described with respect to the preferred embodiments, it will be understood by those skilled in the art that various changes and modifications may be made without departing from the spirit and scope of the invention as defined in the following claims.

What is claimed is:

1. An assembly structure of a cooling air supplying duct for use in a refrigerator having cantilever shelves, the assembly structure comprising:

a shelf supporting rail having a front wall in which a plurality of engagement slots are formed, the shelf supporting rail being vertically fixed on an inner wall of the refrigerator; and a cooling air discharging duct including:

an engaging opening formed in a portion thereof; and a front wall in which a plurality of cooling air discharging holes for discharging cooling air to an interior of the refrigerator are formed, wherein the shelf supporting rail is combined with the cooling air discharging duct by being inserted into the engaging opening, and supports the cantilever shelves; and wherein both sidewalls of the shelf supporting rail have connection holes formed therein, and elastic plugs are formed on both sidewalls of the engaging opening of the cooling air discharging duct; and wherein the elastic plugs are engaged into the connection holes when the shelf support rail is inserted into the engaging opening.

2. The assembly structure of claim 1, further comprising a decorative cover part, wherein when the cantilever shelves are full-width cantilever shelves, a height of the front wall of the shelf supporting rail is less than that of the front wall of the cooling air discharging duct, and the decorative cover part is inserted into the engaging opening after the shelf support rail is inserted into the engaging opening.

3. The assembly structure of claim 1, wherein when the cantilever shelves are half-width cantilever shelves, a height of the front wall of the shelf supporting rail is substantially equal to that of the front wall of the cooling air discharging duct, and the plurality of the engagement slots formed in the front wall of the shelf supporting rail are arranged in two columns.

* * * * *